US006000691A

United States Patent [19]

Chmelař

[11] Patent Number: 6,000,691

[45] Date of Patent: Dec. 14, 1999

[54] DEVICE FOR LIFTING OF PAPER SHEET STACK TO THE LOADING HEAD OF A PRINTING MACHINE

[75] Inventor: Jaromír Chmelař, Dobruška, Czech Rep.

[73] Assignee: Dobrusske Strojirny a.s, Czech Rep.

[21] Appl. No.: 09/081,544

[22] Filed: May 19, 1998

[30] Foreign Application Priority Data

May 19, 1997 [CZ] Czech Rep. ..... 1515-97

[51] Int. Cl.[6] ..... B65H 1/30

[52] U.S. Cl. ..... 271/158; 271/218

[58] Field of Search ..... 271/157, 158, 271/159, 218; 414/795.8

[56] References Cited

U.S. PATENT DOCUMENTS

| | | | |
|---|---|---|---|
| 3,269,725 | 8/1966 | Schwebel | 271/159 |
| 4,174,831 | 11/1979 | Marass et al. | 271/159 |
| 5,116,041 | 5/1992 | Pollich . | |
| 5,294,108 | 3/1994 | Pollich et al. . | |
| 5,295,681 | 3/1994 | Blaser . | |
| 5,529,456 | 6/1996 | Luxem et al. . | |
| 5,538,238 | 7/1996 | Filsinger . | |

FOREIGN PATENT DOCUMENTS

| | | | |
|---|---|---|---|
| 1099556 | 2/1961 | Germany . | |
| 2637086 | 12/1977 | Germany | 271/159 |
| 92 18 195 U | 12/1993 | Germany . | |

*Primary Examiner*—David H. Bollinger
*Attorney, Agent, or Firm*—Ostrolenk, Faber, Gerb & Soffen, LLP

[57] ABSTRACT

Device for lifting of a paper sheet stack to a loading head of a printing machine where the paper sheets are deposited in a stack and taken off from at its top. The device is provided with a NON-STOP loader with a supporting grillage (6) formed of bars and an auxiliary lifting device for this grillage (6). The supporting grillage (6) is in contact with an extractable rear lifting beam (3) of an auxiliary stack (4). By one of its ends the extractable rear lifting beam (4) of the auxiliary stack (4) is mounted in the lifting device, which is placed on the non-serviced machine side and it is secured against pulling out. The other end of the extractable rear lifting beam (3), auxiliary stack (4), which is on the operator's side of the machine is loose. After use the device against pulling out is released and deposited somewhere outside the machine so that it does not hamper the operator in providing normal loader functions.

4 Claims, 2 Drawing Sheets

DEVICE FOR LIFTING OF PAPER SHEET STACK TO THE LOADING HEAD OF A PRINTING MACHINE

FIELD OF THE INVENTION

The present invention relates to a device for lifting of a paper sheet stack to a loading head that takes off individual paper sheets from the stack and moves them to a conveyer belt that moves them further into a printing machine.

BACKGROUND OF THE INVENTION

In printing machines, the paper sheet stack is lifted gradually according to the sheets taken off by means of a lifting device to a loading head. The loading head takes off individual sheets of paper from the top level of the stack and moves them further, usually to a conveyer belt. The lifting device is usually provided with a board on which a stack of paper sheets is resting. The board is moved upwards by means of brackets that are lifted by a chain. The brackets are guided in guiding bars so as to keep the top surface of the stack at the working level of the loading head. In the past, it was necessary to stop the machine first and then to fill a new stack of paper sheets. Thereby, the printing process was regularly interrupted and a time loss was caused when a new paper sheet stack was being filled. This time loss was further increased in case of a repeated printing machine set-up at the printing process re-start. An improvement was brought by the device called NON-STOP loader. This loader allows refilling of a new paper sheet stack having a limited lower height. It is not necessary to interrupt the printing process of the printing machine and there are no time losses in printing orders of a large number of copies. Use of a NON-STOP loader is generally known and manufacturers of printing machines deliver it as a supplementary device to the loading device for take-off and transport of paper sheets into a printing machine.

Apart from the lifting device of the main paper sheet stack, the NON-STOP loader is usually provided with an auxiliary lifting device having an independent lifting chain, guiding elements and lifting elements. It makes possible to take over the lifting function of the main stack at a sufficient time reserve before the take-off of the last paper sheets from the main sheets stack; e.g. by putting a system of bars making a grillage under the remnant of the main stack. Without interrupting the sheets take-off at the top surface of the auxiliary stack, the board with the main stack can be moved down to the bottom level. The board is refilled again with a new paper sheet stack having a height, which is just below the bottom edge level of the lifting beam of the auxiliary stack of the NON-STOP loader. Thereafter, the board with a new main stack is lifted upwards. When it arrives to the top, under the upper auxiliary stack, it supports the grillage formed by bars from the bottom and takes over the lifting of the auxiliary stack After the supporting bars of the grillage have been removed, the board with the main stack continues in lifting of the whole stack. This stack is now composed of the remnant of the original stack, which is now the auxiliary one, and of a new main one, which is beneath.

The lifting device of the auxiliary stack is formed by a front beam and a rear beam that serve in supporting and lifting the bottom bars of the auxiliary stack. The bars are suspended on chains. Movement of the chains is synchronised for the front and the rear beams of the auxiliary stack. However, it is independent of the main stack lifting device chain movement. The guiding bars of the front beam and of the rear beam of the auxiliary stack are situated in front of the auxiliary stack and behind it, outside the plan of the main stack bearing board. Therefore, the guiding bars have to be fixed to the front side of the machine at the loading head. If the guiding bars are fixed directly on the machine frame on both sides, it is on the operator's side and the other side, then the machine frame reaches behind the verge of the main stack board. The guiding bars can be fixed also by means of a special structure, which is an integral part of the machine in the so equipped machines and reaches again behind the verge of the main stack board in the direction out of the machine. This placing of beams guiding exactly on the operator's side makes a free and barrier-free movement of an operator during paper loading and machine set-up impossible, and this even in spite of the fact that this rear beam of the NON-STOP loader is dismounted from the bearing chains suspensions when not in use. The prolonged machine frame is disadvantageous also because it limits movement of an operator both around the paper stack and around the loading head and above them.

SUMMARY OF THE INVENTION

The above mentioned drawbacks are substantially removed in a device for lifting paper sheet stacks to the loading head of a printing machine where the paper sheets are deposited in a stack and taken off at its top. The device is provided with a NON-STOP loader with a supporting grillage formed of bars and an auxiliary lifting device for this grillage. The present invention consists in that the supporting grillage is in contact with an extractable rear lifting beam of the auxiliary stack. By one end, the extractable rear lifting beam of the auxiliary stack is mounted in the lifting device, which is placed on the non-serviced machine side. The other end of the extractable rear lifting beam of the auxiliary stack, which is on the serviced side, is loose.

The extractable rear lifting beam of the auxiliary stack is inserted into a pulling rider of the lifting device and it is secured in it against a movement out. The pulling rider of the lifting device is suspended on a chain, movement of which is synchronised with the movement of the lifting chain of the auxiliary stack front beam.

This arrangement makes possible to make the machine frame shorter on the operator's side up to the main stack guiding bars what usually is in the axis of the sheets stack. This arrangement does not require to add to the machine any auxiliary construction for guiding of the auxiliary stack rear beam on the operator's side up to behind the main stack board. It makes possible to reach the maximum free space for an operator, an easy stack handling, time saving during set-up and provides a barrier-free access to the parts of the machine loading device. After use, the rear lifting beam can be pulled out and deposited outside the machine, to prevent that it hinders operator in providing normal loader function.

BRIEF DESCRIPTION OF THE DRAWINGS

The invention will be further illustrated with reference to the attached drawings where.

EXAMPLES OF EMBODIMENT OF THE INVENTION

Figure 1:
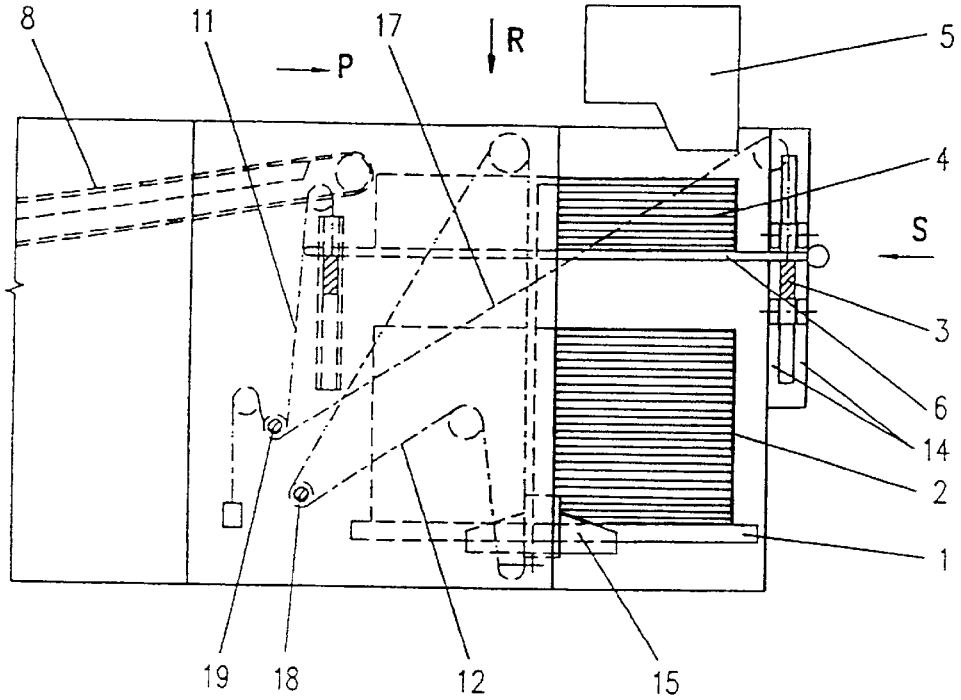
FIG. 1 shows the device in side view from the operator's side of the machine.
Figure 2:
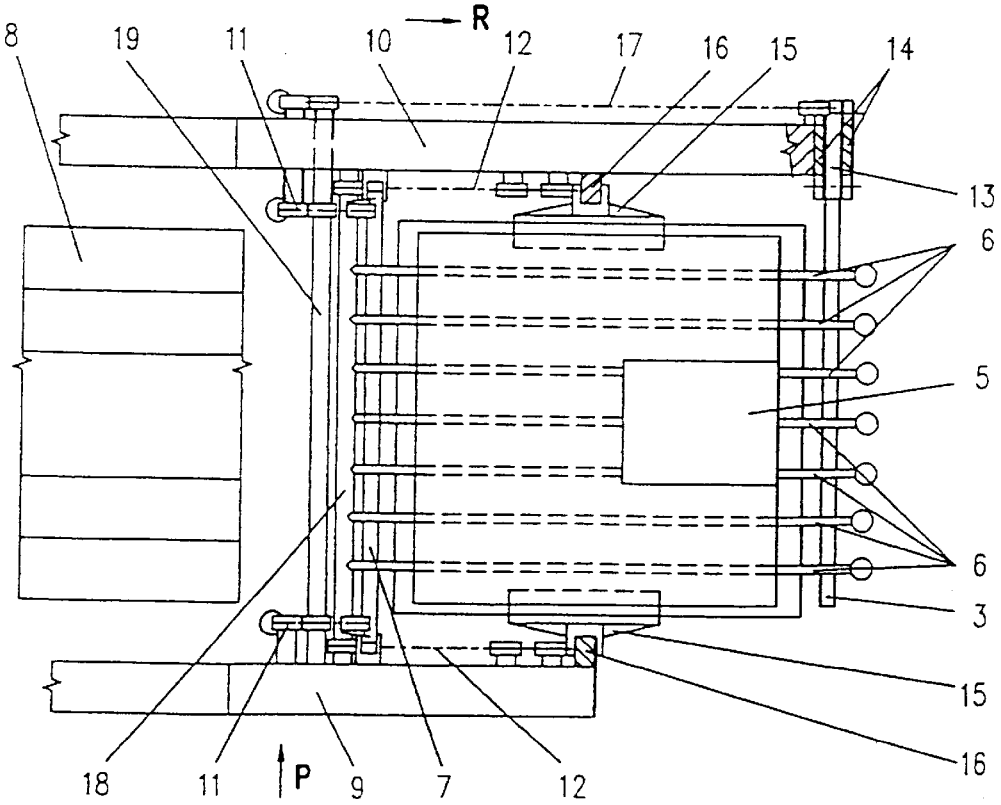
FIG. 2 shows the top view of the device.
Figure 3:
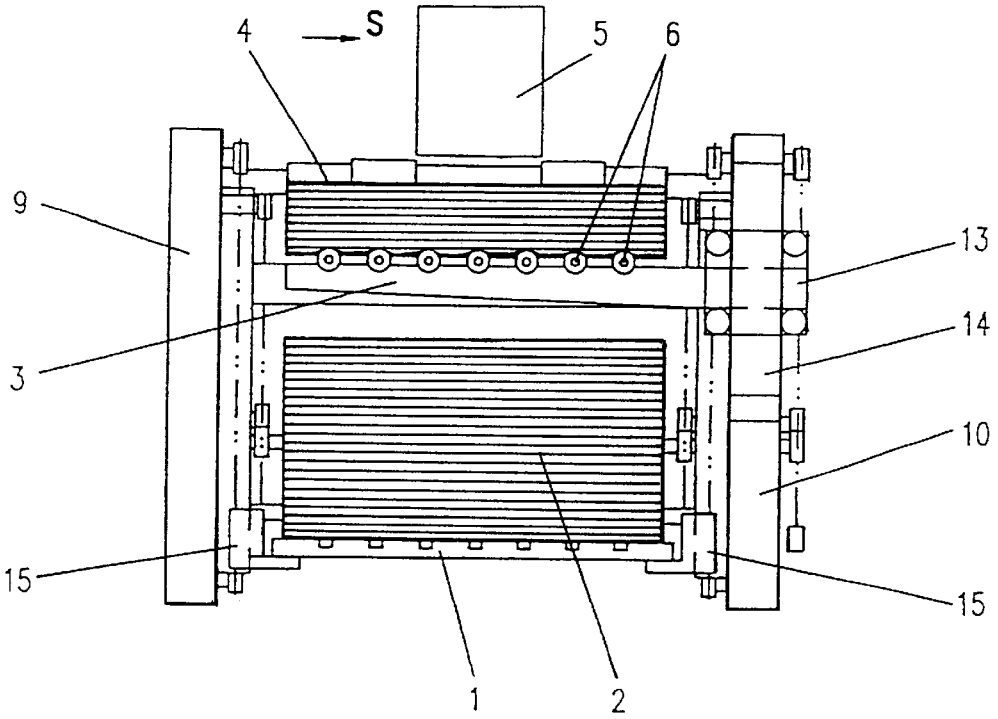
FIG. 3 shows the device in front view from the loading head and FIG. 4 shows the device in top view after extraction of the rear beam of the auxiliary stack of the NON-STOP device.
Figure 4:
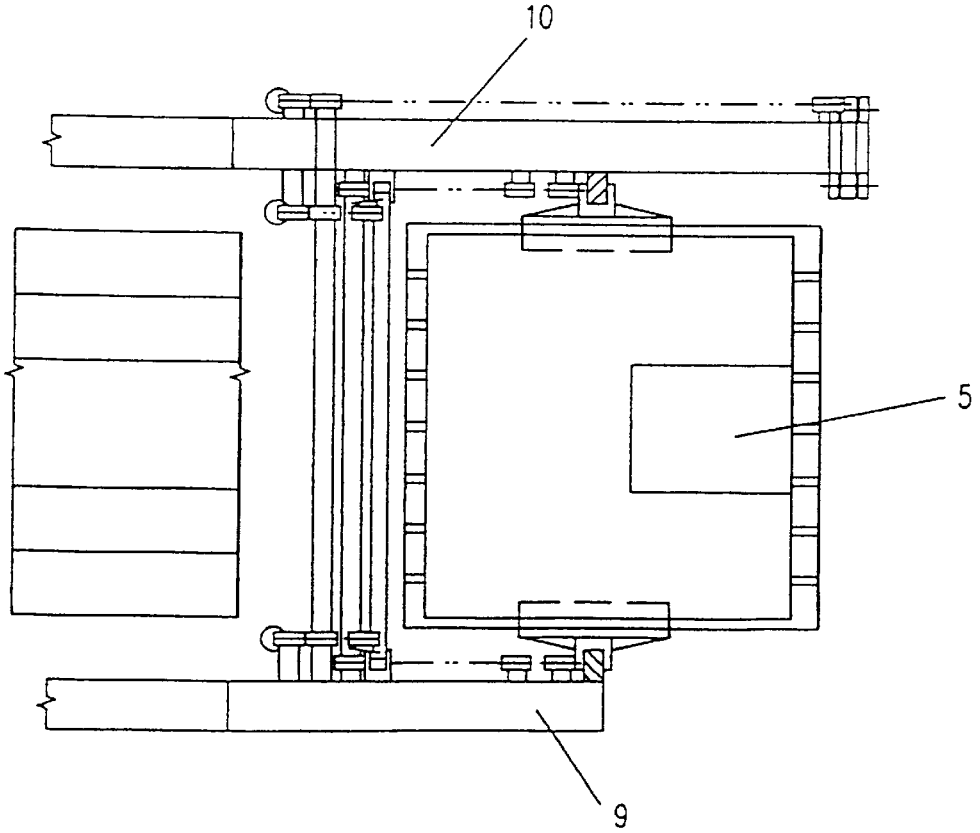

The device is comprised of a front frame 9, which is on the operator's side and of a rear frame 10, which is on the opposite side, i.e. on the non-serviced side of the machine. Between these frames 9 and 10 a board 1 is placed. The board 1 is supported by brackets 15 guided by main guiding rods 16. The brackets 15 are carried by main chains 12 on both sides of the machine in the vicinity of both frames 9 and 10. The main paper sheet stack 2 is put on the board 1. The main chains 12 are wound around one common driving main shaft 18. In front of the board 1, the front beam 7 of the auxiliary stack 4 is suspended on the first chain 11 of the auxiliary stack 4. Behind the board 1, the pulling driver 13 with the overhung suspended extractable lifting rear beam 3 of the auxiliary stack 4 is suspended on the other chain 17 of the auxiliary stack 4. The pulling rider 13 is guided in guiding rods 14 of the auxiliary stack 4. The guiding rods 14 of the auxiliary stack 4 are fastened at the end of the rear frame 10, which is on the non-operated machine side. Both chains 11 and 17 of the auxiliary stack 4 are wound around one common driving shaft 19 of the auxiliary stack 4. The front beam 7 of the auxiliary stack 4 as well as the extractable rear beam 3 of the auxiliary stack 4 are in contact with the supporting grillage 6 formed by a system of rods from the bottom. The rods 6 overlap the board 1 of the main stack 2 in front and behind the stack 2. On the supporting grillage 6, an auxiliary stack 4 of paper sheets is deposited. Above it, the loading head 5 is placed. In front of the auxiliary stack 4, the belt conveyor 8 is placed at the operating level of the loading head 5.

When the device is in operation, the board 1 of the main stack 2 lifts the main stack 2 to the loading head 5 so that the top surface of the main stack 2 is at the operating level of the loading head 5. The loading head 5 takes off the top sheets of the main stack 2 and shifts them onto the belt conveyor 8 and further into the printing machine. At the time when only a small number of paper sheets remains in the main stack 2 and it would be necessary to stop the sheet loading and, therefore, also the printing machine, it is possible to use the so called NON-STOP loading device. This makes possible to refill the dispensing main paper sheet stack 2 in the bottom, whereby paper sheets are taken off by the loading head 5 continuously from the top surface of the main stack 2. The supporting grillage 6 of rods is put under the remnant of the main stack 2. It is possible to lift it up from the bottom by means of the front beam 7 of the auxiliary stack 4 and the extractable rear lifting beam 3 of the auxiliary stack 4. The extractable rear lifting beam 3 of the auxiliary stack 4 can be inserted and secured in the pulling rider 13 of the auxiliary stack 4 lifting device, and this on the non-serviced machine side, at the rear frame 10. This is carried out in case when the auxiliary lifting device of the NON-STOP loader has to be used. If the auxiliary lifting device is not used, it can be deposited outside the machine.

Gradual lifting of the auxiliary paper sheet stack 4 to the loading head 5 is provided by the driving shaft 19 of the auxiliary stack 4, the first chain 11 of the auxiliary stack 4, the other chain 17 of the auxiliary stack 4, the front beam 7 of the auxiliary stack 4 and the extractable rear lifting beam 3 of the auxiliary stack 4. Both chains 11 and 17 are synchronised. The board 1 itself of the main stack 2 can then move down to the bottom position and it is possible to refill the stack of paper sheets, which is resting on it, up to tight under the bottom edge of the extractable rear lifting beam 3. The main lifting device then moves a little bit the lower, now again the main stack 2 so that it now touches from beneath the supporting grillage 6 formed by rods. So as the lifting continues, the function of lifting the main stack 2 and the auxiliary stack 4 is taken over by one main lifting device with board 1. The supporting grillage 6 of rods will be taken away by gradual pulling out those rods that are between the main stack 2 and the auxiliary stack 4. The loading head 5 can take away paper sheets from the whole stack which is in reality comprised of the main stack 2 and the auxiliary stack 4, without causing any interruption in the paper sheets loading into the machine. The extractable rear lifting beam 3 of the auxiliary stack 4 can be released and pulled out from the pulling rider 13 of the lifting device and deposited somewhere outside the machine. Thereby, free space is again provided on the operator's side of the machine around the main stack 2 as well as around the auxiliary paper sheet stack 4 for a barrier-free handling around the loader.

INDUSTRIAL USE

An embodiment of the device in accordance with the present invention will find use in loading of individual paper sheets from a stack by a loading head and for passing it on to a belt conveyor transporting it to a printing machine.

1 Board
2 Main stack
3 Extractable rear lifting beam 3 of the auxiliary stack 4
4 Auxiliary stack
5 Loading head
6 Supporting grillage
7 Front beam 7 of the auxiliary stack 4
8 Belt conveyor
9 Front frame
10 Rear frame
11 The first chain 11 of the auxiliary stack 4
12 Main chain
13 Pulling rider
14 Guiding rods 14 of the auxiliary stack 4
15 Brackets
16 Guiding rods 16 of the main stack 2
17 Second chain 17 of the auxiliary stack 4
18 Main shaft
19 Driving shaft 19 of the auxiliary stack 4

I claim:

1. In a device for lifting of a paper sheet stack to a loading head of a printing machine where the paper sheets are deposited in a stack and taken off at its top, said device provided with a NON-STOP loader with a supporting grillage formed of bars and an auxiliary lifting device for this grillage, the improvement which comprises the supporting grillage (6) being in contact with an extractable rear lifting beam (3) for an auxiliary stack (4) having first and second ends, the first end mounted in a lifting device which is placed on the non-serviced machine side and the second end of the extractable rear lifting beam (3) loose.

2. Device according to claim 1, characterised in that the extractable rear lifting beam (3) of the auxiliary stack is inserted into the openings of a pulling rider (13) of the lifting device and secured against movement therefrom.

3. Device according to claim 2 in combination with a printing machine having a loading head.

4. Device according to claim 3, wherein the printing machine has a serviced side and an non-serviced side and wherein the first end of the rear lifting beam is disposed on the non-serviced side.

* * * * *